US005236113A

United States Patent [19]

Wisser

[11] Patent Number: 5,236,113

[45] Date of Patent: Aug. 17, 1993

[54] ATTACHMENT OF SECURITY STRAPS TO HANDGUN HOLSTER

[75] Inventor: Glenn Wisser, Meridian, Id.

[73] Assignee: Michaels of Orgeon Co., Portland, Oreg.

[21] Appl. No.: 781,488

[22] Filed: Oct. 21, 1991

[51] Int. Cl.[5] ..... F41C 33/02

[52] U.S. Cl. ..... 224/243; 224/193; 224/242; 224/250; 224/911

[58] Field of Search ..... 224/243, 193, 242, 245, 224/250, 253, 911

[56] References Cited

U.S. PATENT DOCUMENTS

| | | | |
|---|---|---|---|
| 4,022,361 | 5/1977 | Devlin | 224/911 X |
| 4,143,798 | 3/1979 | Perkins | 224/243 |
| 4,270,680 | 6/1981 | Bianchi | 224/193 |
| 4,312,466 | 1/1982 | Clark | 224/243 |
| 4,480,776 | 11/1984 | Atkins, Sr. | 224/243 |
| 4,645,103 | 2/1987 | Bianchi et al. | 224/243 |
| 4,696,419 | 9/1987 | Holtzclaw, Jr. et al. | 224/243 |
| 4,718,585 | 1/1988 | Atkins, Sr. | 224/238 |
| 4,750,655 | 6/1988 | Barry | 224/243 |
| 4,966,320 | 10/1990 | De Santis et al. | 224/229 |
| 5,058,788 | 10/1991 | Newmark | 224/222 |

*Primary Examiner*—Allan N. Shoap
*Assistant Examiner*—Vanessa Caretto
*Attorney, Agent, or Firm*—Chernoff, Vilhauer, McClung & Stenzel

[57] ABSTRACT

A handgun holster having security straps releasably attached by a fastener system including hook-and-loop fastener material, with a protective cover overlying a portion of the mated hook-and-loop fastener material located on the holster. The protective cover is constructed of a flexible sheet-like material and helps to define a snug tube or pocket for receiving a portion of a security strap bearing the mating portion of the hook-and-loop fastener material thereon. The cover holds the two portions of the fastener material together in mating confrontation and covers an end of the strap to prevent it from easily being separated from the holster. Alternatively, a loop-carrying portion of fastener material is attached to a holster with the loops facing toward the body of the holster and a strap having the hook-carrying portion of the fastener is placed between the body of the holster and the loop-carrying fastener material.

12 Claims, 4 Drawing Sheets

ATTACHMENT OF SECURITY STRAPS TO HANDGUN HOLSTER

BACKGROUND OF THE INVENTION

The present invention relates to handgun holsters, and more particularly, to handgun holsters with security straps attached by hook-and-loop fastener material.

A handgun holster adaptable to more than one particular size and type of handgun can be made of leather, of a sandwich-type or layered fabric construction or of some other suitable material. Such a holster, adaptable to carry a range of sizes of handguns, often includes some type of security strap that extends around a holstered handgun to hold the weapon securely in the holster.

The holster is most versatile if the security straps are adjustable to hold a particular make and model of handgun, from the group of handguns for which the holster is suitable, snugly in the holster. It is well-known to increase the adjustability of the security straps by securing the straps to the holster using a hook-and-loop fastener system such as that sold under the trademark Velcro. One portion of the fastener material is attached to one end of a security strap; the mating portion of the fastener material is fastened to the body of the holster. The effective length of the security strap and angle of attachment of the security strap to the body of the holster can then be adjusted as desired for a particular handgun. So long as the security strap is fastened to hold a handgun in the holster the security strap is fairly securely attached to the body of the holster. However, when the security straps are loosened to allow the handgun to be removed from the holster the security straps may become separated from the body of the holster.

This well-known type of security strap attachment also has certain other drawbacks. The attached end of the security strap of previously-known holsters is exposed and thus can be pulled loose from the holster, gradually or as the result of being caught against something. Additionally, the many hooks of one part of the fastener material may become clogged with lint or other small particles, thereby compromising the security of the security strap.

A security strap for such a holster is commonly made of nylon webbing cut with a hot knife to prevent the webbing from unravelling. Cutting the strap in such a manner often leaves the strap with a hard edge that can abrade holes in the clothing of the holster wearer, particularly when the end of the strap is pushed against the wearer by the weight of a handgun.

Clark U.S. Pat. No. 4,312,466 discloses an adjustable security strap that is attached to a leather flap by hook-and-loop fastener material. The leather flap provides some protection for the fastener material and also protects the clothes of a holster wearer from abrasive contact with the end of the security strap, but the flap arrangement is undesirably bulky.

It is also known as part of attaching a security strap to a holster to include a short piece of plastic or nylon webbing extending across the upper end of that portion, generally the loop-carrying portion, of the hook-and-loop fastener material attached to a holster. Such a small piece of webbing is permanently fastened to the holster by its ends to extend over the loop portion of the fastener material on the holster to resemble a belt loop through which the end of a security strap, carrying the mating portion of the fastener material, can be placed.

This piece of webbing extending across the security strap near the top of such a holster may help prevent loss of the security strap but does nothing to solve the abrasion problem, nor does it aid in keeping the fastener material hooks free of lint and dust, and the security strap can still be pulled loose from the holster with a fairly small effort.

What is still needed, then, is a compact structure for protecting an adjustable security strap from accidental or undesired separation from a handgun holster while simultaneously protecting the clothing of the holster wearer from abrasion, and while preserving the adjustability of attachment of the strap.

SUMMARY OF THE INVENTION

The present invention is a handgun holster having at least one adjustable security strap attached by an improved arrangement using mating hook-and-loop fastener material. The adjustable security straps are secured to the outside of the holster with hook-and-loop fastener material of the type such as that generally referred to by the trademark Velcro. A cover of sheet-like material is secured over some of that portion of the hook-and-loop fastener material attached to the holster, and the cover and fastener material form a snug, flat tube or pocket into which an end of the security strap bearing the cooperatively mating portion of the hook-and-loop fastener material is placed for attachment. The cover prevents the strap and its attached fastener material from easily being separated from the fastener material of the holster, and also covers the end of the strap, preventing it from abrading the cloth of a holster wearer.

The cover can be of any sheet-like material of adequate strength and flexibility, such as a sturdy nylon cloth. The protective cover can be included on any hand-gun holster with such adjustably attached security straps, regardless of whether the holster is worn exposed or concealed, including hip or shoulder holsters and inside-the-belt holsters.

The security strap is installed in the tube or pocket defined by the cover material and the covered portion of the hook-and-loop fastener material attached to the holster body, preferably by placing a flat, thin, stiff fastener adjustment device such as a flat ruler or a pocket comb as a separator between the cover and the fastener material and then sliding the strap between the cover material and the fastener adjustment device. The adjustment device prevents the hooks of the fastener material from engaging the loops of the fastener material as the strap is placed in the desired position and until the adjustment device is withdrawn. To readjust the security strap the adjustment device is reinserted between the mated pieces of the fastener material, thereby serially disengaging the hooks from the loops, separating the pieces of fastener material and allowing the strap to be repositioned.

In another embodiment of the invention one of the pieces of fastener material is attached to an article with the fastener loops or hooks facing toward the article, such as a holster, so that a receptacle in the form of a sleeve or pocket is formed cooperatively by the article and the piece of fastener material. The strap, with the mating fastener material, is covered by and held between the article and the attached piece of fastener material, keeping the pieces of fastener material closely alongside each other and mated.

It is therefore a principal object of the invention to provide a more secure adjustable attachment for security straps to objects, as in attachment of security straps to a handgun holster.

It is another important object of the invention to provide a covering for a hard or rough end of a security strap or the like attached to a handgun holster to protect the clothing of a holster wearer from abrasion.

It is a further object of the invention to provide a holster in which the end of a security strap attached to the body of a holster is covered to prevent dust and lint from accumulating in the hooks of the hook-and-loop fastener material used for attaching the security strap to the holster, in order to maintain effectiveness of the hook-and-loop fastener material.

It is a feature of one embodiment of the invention that it includes a pocket to receive and cover an end of a security strap and thus hold together two mating pieces of fastener material.

The foregoing and other objectives, features, and advantages of the invention will be more readily understood upon consideration of the following detailed description of the invention, taken in conjunction with the accompanying drawings.

DETAILED DESCRIPTION OF THE INVENTION

Figure 1:
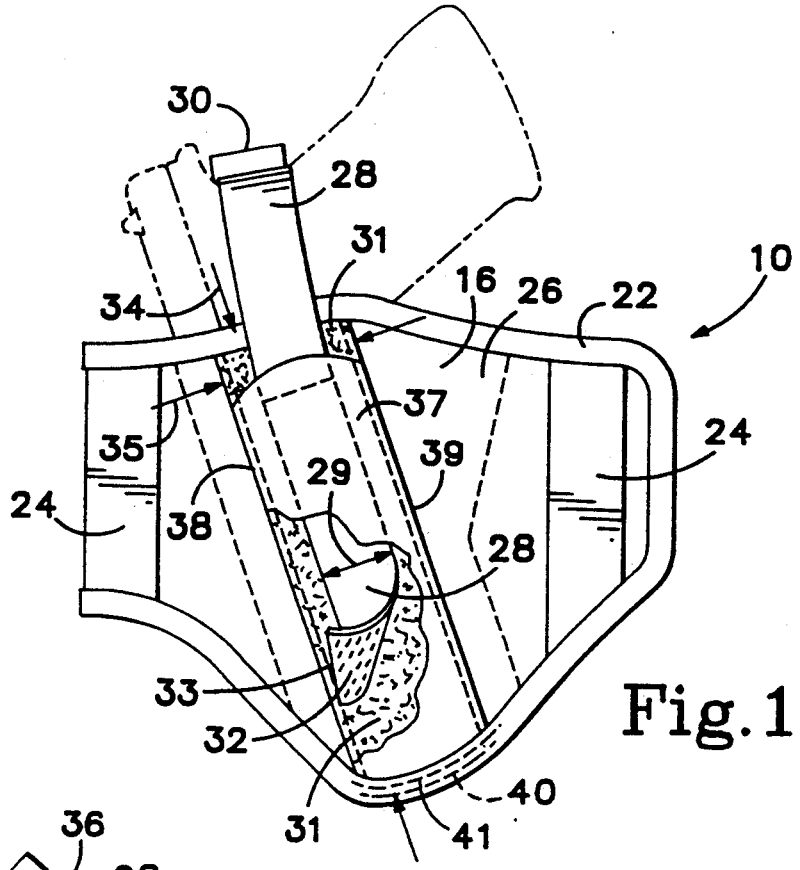
FIG. 1 is a partly cut-away side elevational view of a holster in which two security straps are attached to the holster by a hook-and-loop fastener system embodying the present invention, showing the two security straps fastened together over a weapon.

Referring now to the drawings, FIGS. 1, 2, 3, and 4 show a flat holster 10 of laminated fabric construction which is a preferred embodiment of the present invention.

Figure 4:
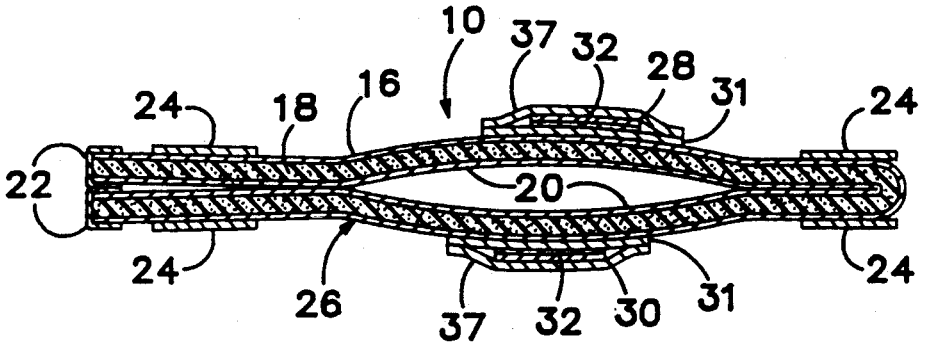
FIG. 4 is a sectional view taken along line 4—4 of FIG. 3 showing the layered sandwich-type construction of the holster.

As seen in FIG. 4, a holster 10 is of a sandwich-type construction to which the present invention is particularly suited. Such a handgun holster construction is disclosed more particularly in Cook U.S. Pat. Nos. 4,485,947 and 4,485,948, the disclosures of which are hereby incorporated herein by reference. It will be evident, however, that holsters constructed of other materials, such as leather, could also include the present invention.

The construction of a holster in connection with which the present invention is useful must be such that it is possible to securely fasten one piece of a mating pair of pieces of a hook-and-loop fastener system, such as that marketed under the trade name Velcro, to the body of the holster.

As shown in FIG. 4, the holster 10 includes an outer layer 16, which can be a 12-ounce nylon cloth, a median layer 18, which can be a yieldably firm elastomer such as a closed-cell polyethylene foam, and an inner layer 20, formed of a soft-surfaced fabric to protect the finish of a handgun inserted into the holster 10. The three layers are preferably adhesively laminated together, and the exposed edges of the layers are bound by a stitched-on tape or ribbon 22 of a suitable material such as nylon. Fabric belt loops 24 on both sides allow holster 10 to be worn either right-handed or left-handed.

Referring again to FIGS. 1, 2 and 3, the holster 10 has a body 26, and two security straps 28 and 30, of nylon webbing of width 29 of about one inch, for example, are secured to the outside of the body 26 of the holster 10 by mating pieces of hook-and-loop fastener material. Preferably, the piece of loop-carrying fastener material 31 is sewn onto the outside of the body 26 of the holster 10 and the piece of mating hook-bearing fastener material 32 is sewn or otherwise firmly affixed to the security strap 28, extending from its attached or lower end 33 a distance of, for example, two to four inches lengthwise along the security strap 28. The lower or attachment end 33 of the security strap 28 may have a hard surface as a result of being cut with a hot knife to prevent fraying of the fabric.

It will be noted that the length 34 and width 35 of the piece 31 of hook-and-loop fastener material located on the outside of the body 26 of the holster 10 must be adequate to allow the security strap 28 containing the opposing or mating hook-and-loop material to be attached adjustable in various positions and locations. In a preferred embodiment, the width 35 of the piece of loop-carrying pile material 31 on the holster is great enough to allow the security strap 28 carrying the mating hook-carrying fastener material 32 to be adjusted to the optimum angle for securing a particular handgun placed in the holster 10, and the length 34 is great enough to permit the security strap 28 to be adjusted longitudinally to provide a desired effective length of the free, or handgun securing, portion to a fastener such as one of the mating parts of a snap fastener 36. Once their positions have been adjusted the security straps 28 and 30 can be secured snugly around a handgun held in the holster, by use of the snap 36.

A cover 37 of a strong sheet material is attached to the outside of the body 26 of the holster 10, and closely overlies a portion of the piece of loop-carrying fastener material 31 attached to the body 26, as shown in FIG. 1. The cover 37 lies snugly against and parallel with the hook-carrying piece of fastener material 32, forming a flat, tight receptacle in the form of a pocket to receive the attached end 33 of the security strap 28. The cover 37 is large enough to overlie enough of the piece of loop-carrying fastener material 31 attached to the body 26 and provide the desired amount of adjustability of the position of the security strap 28. The cover 37 is located so as to overlie enough of the piece of fastener material on the body 26 of the holster 10 to cover the end 33 of the security strap plus enough of the length of the attached end portion of the security strap 28 to securely attach the strap to the body 26 of the holster 10.

In the holster 10 incorporating the sandwich-type construction that includes a central layer 18 of an elastomer such as a closed-cell foam, a handgun secured in the holster tends to press the central layer 18, thereby exerting some outward pressure on the piece 31 of hook-and-loop fastener material on the outside of the holster 10. With the cover 37 overlying the piece of hook-and-loop fastener material on the holster 10, the security strap 28, interposed between the cover 37 and the body 26 of the holster, is closely pressed against the holster ensuring an intimate, secure mating of the hook-carrying material 32 on the security strap 28 with the loop-carrying material 31 on the holster body 26.

The cover 37 is preferably of a smooth, tough, sheet-like material which may be flexible. A preferred material for the cover 37 is a standard two-inch wide light-weight woven nylon webbing material such as that available as No. 1106 Nylon web material from California Webbing of Los Angeles, California. Other strong sheet-like materials such as leather, imitation leather, or flexible plastics could also be used.

The cover 37 is fastened in place over the hook-and-loop fastener material on the body 26 of the holster at least along two generally opposite margins 38 and 39, where it may be sewn to the body 26 of the holster 10 in the same seams which attach the corresponding margins of the piece of loop-carrying fastener material 31. The cover 37 and the loop-carrying fastener material 31 it overlies then together form a flat tube open toward the top of the holster body 26 to receive and cover the end 33 of the security strap 28. With the security strap 28 thus covered, its lower end 33 cannot abrade the clothing of the holster wearer, and the hook-carrying fastener material is protected against becoming clogged with lint or other material which could degrade its performance.

The cover 37 can also be fastened to the outside of the body 26 of the holster 10 along a third margin 40, as by being sewn to the body 26 of the holster 10 in the seam 41 attaching the binding ribbon 22 around the laminated fabric of the holster body and the loop-bearing fastener material 31. This construction forms a pocket with a closed lower end in which to receive and cover the end 33 and adjacent attachment portion of the security strap 28 and the piece of mating hook-bearing fastener material 32.

It will be understood that if the piece of loop-bearing hook-and-loop fastener material 31 attached to the body 26 of the holster 10 is large enough, the cover 37 may overlie only a part of the fastener material 31, leaving a part of the fastener material uncovered, as long as the cover 37 and fastener material together still form a tube or pocket to receive the end 33 and an adjacent portion of the security strap 28 including the attached fastener material 32.

Figure 2:
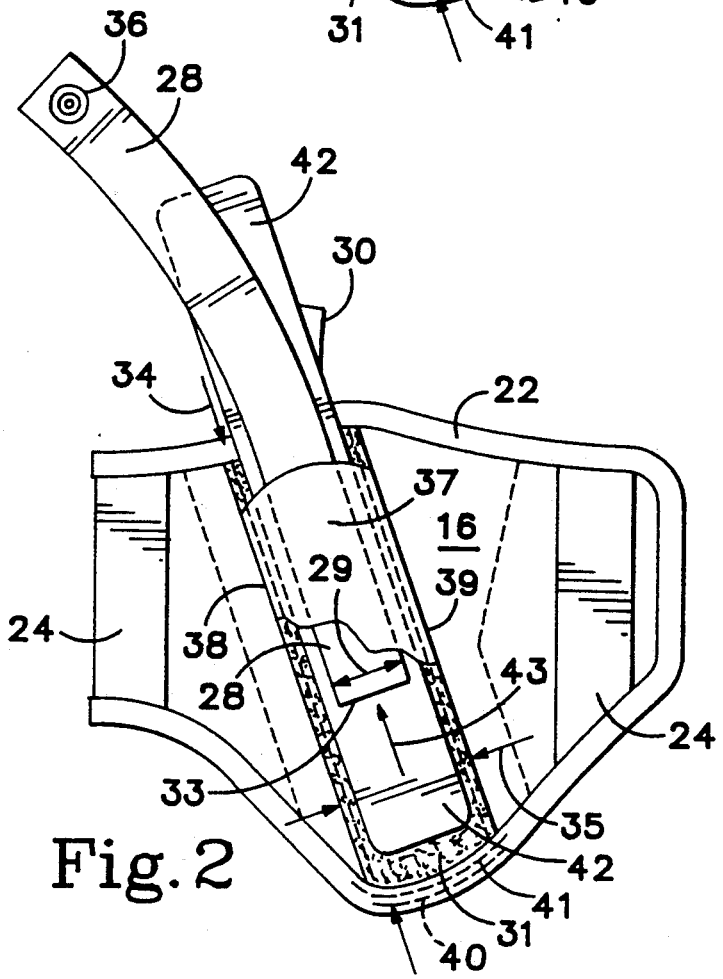
FIG. 2 is a partially cut-away side elevational view of the holster shown in FIG. 1 showing the manner of adjustment of the security strap.

FIG. 2 illustrates the manner of installing and adjusting the attachment of a security strap 28 on the holster 10 according to the present invention. An adjustment device 42 is inserted into the pocket defined between the cover 37 and the loop-carrying fastener material 31 attached to the holster body 26. The adjustment device 42 can be any thin, stiff object flat and narrow enough to fit behind the cover 37 and long enough to separate the pieces of hook-and-loop fastener material 31 and 32 and prevent them from mating while the security strap 28 is inserted and moved between the cover 37 and the adjustment device 42 to the desired position. Such a common-place item as a ruler, pocket comb, or table knife ordinarily would serve adequately as an adjustment device 42. When the security strap 28 has been positioned as desired and the adjustment device 42 is removed, as indicated by the arrow 43, the hooks and loops of the fastener material quickly engage one another and are closely and securely retained in a mated condition by the cover 37. Simple pulling on the security strap 28 fastened in such a manner with forces even greater than those likely to be encountered is insufficient to separate the security strap from the body 26 of the holster 10, since the hook-and-loop fastener materials 31 and 32 are prevented from being progressively pulled apart. The security strap 28 cannot be accidentally removed or repositioned unless an adjustment device is interposed between the hooks and loops of the fastener material, because the cover 37 holds the hook-and-loop fastener material in a mated condition.

Figure 3:
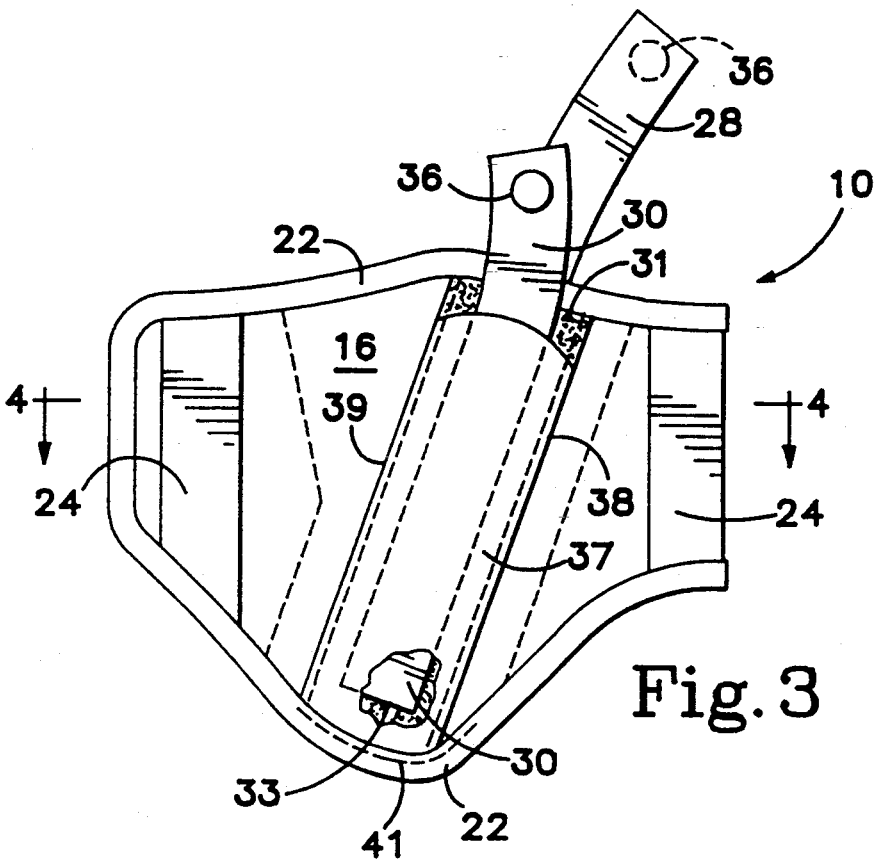
FIG. 3 is a partially cut-away side elevational view of the reverse side of the holster shown in FIG. 1.

Attachment of the security strap 30 to the other side of the body 26 of the holster 10, as shown in FIG. 3, is similar and is adjustable in the same way.

Figure 7:
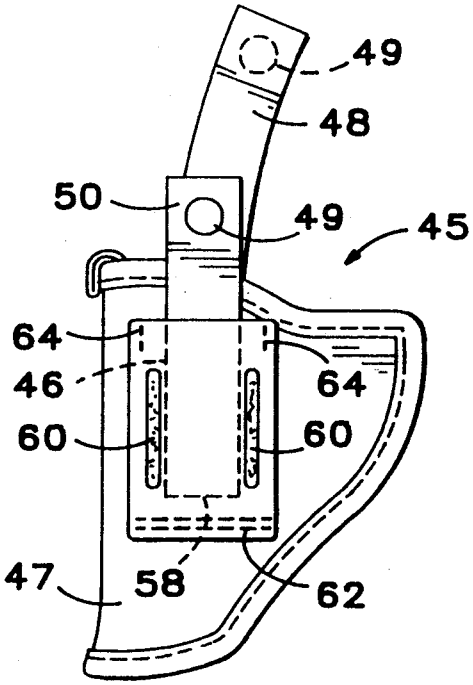
FIG. 7 is an elevational view of the reverse side of the holster shown in FIG. 5, showing the attached end of the thumb break security strap covered by a molded belt loop attachment.
Figure 6:
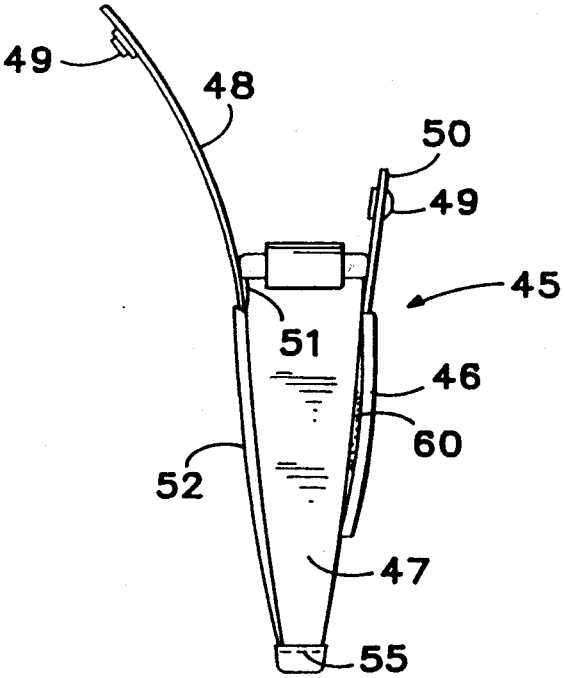
FIG. 6 is view of the holster shown in FIG. 5, taken in the direction of the line 6—6.
Figure 5:
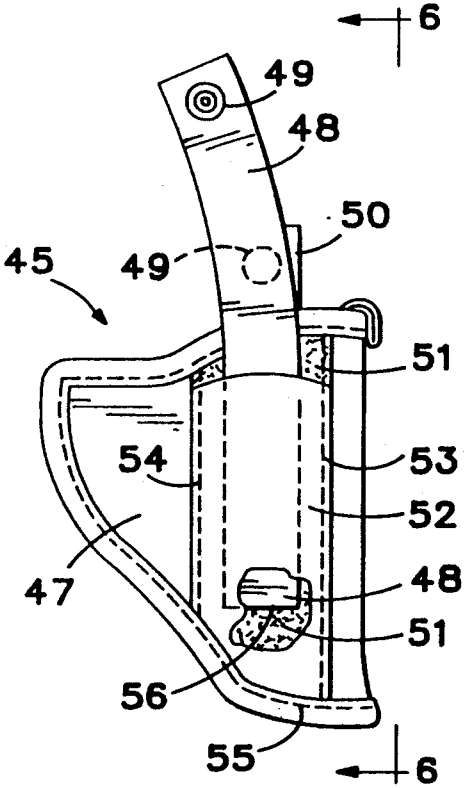
FIG. 5 is a partially cut-away side elevational view of a holster having a security strap attached to the body of the holster by the hook-and-loop fastener material according to the invention and with a rigid thumb break type security strap attached to the opposite side of the holster.

FIGS. 5, 6 and 7 illustrate a hip holster 45 having a molded resilient plastic belt-loop member 46 on one side of the holster's body 47, which may be of laminated fabric similar to the material of the holster 10. A flexible security strap 48 releasably mates, by a snap fastener 49, with a relatively short and stiff thumb break security strap 50, stiffened, for example, by a piece of a suitable resiliently stiff plastic, or a thin strip of spring steel or the like. The flexible security strap 48 is attached to the body 47 on the side normally outwardly exposed, opposite the belt-loop member 46, by mating pieces of hook-and-loop material. A first piece 51 of loop-carrying material is sewn to the body 47 of the holster 45, where a cover 52 of cloth is also sewn to the body 47, along seams 53 and 54 extending along the two parallel sides of the piece of loop-carrying fastener material 51 and a seam 55 extending along the bottom of the holster. The cover 52 thus provides a pocket receiving and covering the end 56 of the security strap equipped, as the security strap 28 described previously, with a piece of hook-carrying fastener material mated with the loop-carrying material 51. The position of the security strap is adjustable in the same way described previously with respect to the security strap 28 of the holster 10.

As seen best in FIG. 7, a lower end 58 of thumb break security strap 50 of holster 45 is secured behind the molded belt loop member 46, which forms a protective cover over the loop fastener material located on the body of the holster. The molded belt loop member 46 and a piece of loop-carrying fastener material 60 sewn to the body 47 of the holster 45 together form a pocket to receive, in an adjustable position, the end 58 of the thumb break security strap 50, which carries a piece of mating hook-carrying fastener material (not shown) facing toward the loop-carrying fastener material 60. The belt loop member 46 is sewn to the body 47 at least along a seam 62 at the bottom of the belt loop member and at two short bar-tack seams 64 at the upper corners of the belt loop member 46, leaving an opening at the top. The flexibility of the holster body 47 and of the belt loop member 46 allow the end 58 of the thumb break security strap 50 to be inserted and positioned adjustably by use of the adjustment device 42, as previously described in connection with the holster 10. The belt loop member 46 serves as a cover, as does the function of the cover 37, to keep the piece of loop-carrying fastener material 60 on the body 47 mated with the hook-carrying fastener material on the thumb break security strap 50, and to protect clothing of a person wearing the holster 45 from being abraded by the end 58 of the thumb break strap or the hooks of the fastener material.

Figure 8:
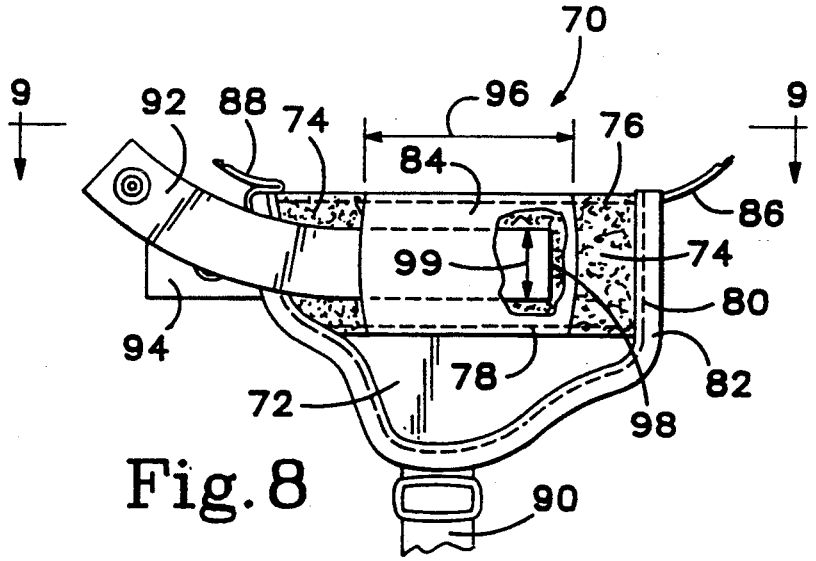
FIG. 8 is a side elevational view of a horizontal shoulder holster, showing attachment of a non-rigid security strap and a rigid thumb break security strap in accordance with the invention.
Figure 9:
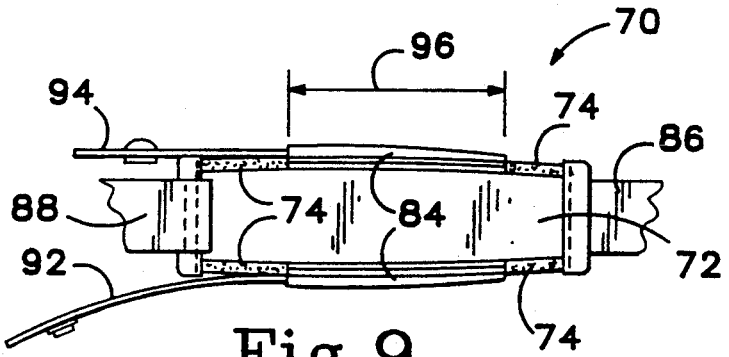
FIG. 9 is a view of the holster shown in FIG. 8, taken in the direction of the line 9—9.
Figure 10:
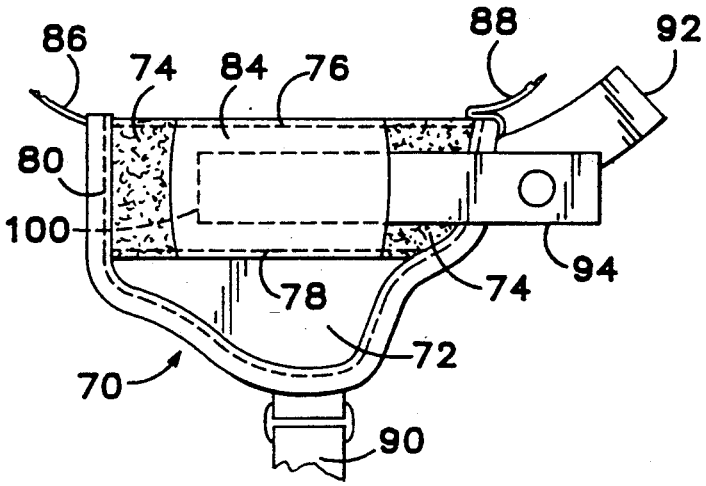
FIG. 10 is an elevational view of the reverse side of the holster seen in FIG. 8 showing the rigid thumb break security strap attached to the holster with hook-and-loop fastener material and protective cover according to the invention.

A horizontal shoulder holster 70 is shown in FIGS. 8, 9, and 10, and includes a body 72 of laminated fabric similar to that of the holsters 10 and 45. A respective piece of loop-carrying hook-and-loop fastener material 74 is sewn to each side of the body 72 of the holster 70, along seams 76 and 78, as well as by the seam 80 which retains an edge tape 82 extending around the holster. Additionally, a respective cover 84, similar to the previously described covers 37 and 52, is sewn to each side of the body 72 of the holster 70 along the seams 76 and 78, so that the cover 84 snugly overlies and is parallel with the surface of the loop-carrying fastener material 74.

Straps 86, 88, and 90, attached to the body 72 of the holster, serve to suspend it when it is worn and do not form a part of the present invention.

A flexible security strap 92, and a relatively rigid thumb break security strap 94 each include a piece of hook-carrying fastener material (not shown) substantially similar to the hook-carrying fastener material 32 shown in connection with the holster 10. The flexible security strap 92 and the thumb break strap 94 are thus held to the body 72 of the holster 70 by mating action of the hook-and-loop fastener material, which is held in a mated condition by the respective cover 84.

It will be noted that each of the covers 84 extends over a length 96 which is less than the entire length of the holster 70, so that both ends of the cover 84 are open. The covers 84 and the pieces of loop-carrying fastener material 74 thus form tubes into which the ends 98, 100 of the security straps 92, 94 can be inserted. An adjustment device 42 similarly can be inserted into the tubes to facilitate insertion of the end 98 or 100 of the respective security strap. The length 96 of the cover 84 need only be sufficient to receive and cover a portion of the security strap including the end 98 or 100, together with a portion of the length of the respective security strap having the loop-carrying fastener material and extending from the end far enough to ensure that a pull on the security strap does not free the security strap 92 or 94 from the body 72 of the holster. In general, a length 96 equal to at least about twice the width 99 of the security strap 92 or 94 is sufficient to provide a secure attachment of the security strap 92 or 94 to the body 72 of the holster.

While the fastener system of the present invention has been described in conjunction with a holster, one skilled in the art will appreciate that the invention is not necessarily limited to holsters and will also appreciate that the security and integrity of a hook-and-loop fastener system for attaching straps or strap-like members in other applications, as well, can be improved by use of the present invention. Adjustable attachments of any strap or strap-like member by the use of a hook-and-loop fastener system wherein one portion of the hook-and-loop fastener material is carried on such a strap or strap-like member may be enhanced by the addition of a sheet-like cover to overlie the other mating portion of the hook-and-loop fastener material closely enough to prevent the attached strap from being pulled outwardly far enough to release the hook-carrying material progressively from its engagement with the loop-carrying material of the fastener combination. Thus, such a cover as the covers 37, 52, or 84 will hold the mating areas of hook-and-loop fastener material together in a mated condition. This cover arrangement provides increased security of the hook-and-loop fastener combination for holding such a strap where tension may be applied to the strap in a direction other than parallel with the portion of the strap to which the engaged hook-and-loop fastener materials are attached.

As previously described, the cover material can be secured over a portion of one member of the hook-and-loop fastener material so that the cover and that portion of the hook-and-loop fastener material overlain by the cover together form a pocket or tube into which the strap or strap-like member bearing the other mating portion of the hook-and-loop fastener material can be inserted with the use of a separator such as the adjustment device 42 to facilitate movement of the strap member within the pocket until it is in the desired position. When thus secured, the strap or strap-like member is protected from unwanted separation from something to which it is attached, and the hook-carrying portion of the hook-and-loop fastener material is protected from becoming clogged with foreign materials which would interfere with its efficiency.

As described above, the hook-carrying portion of the hook-and-loop fastener material has been fastened to a strap and the loop-carrying portion has been fastened to an article to which the strap will be attached. It will be appreciated that the relative positions of the two portions of the hook-and-loop fastener material could be reversed in accordance with the invention.

Figure 11:
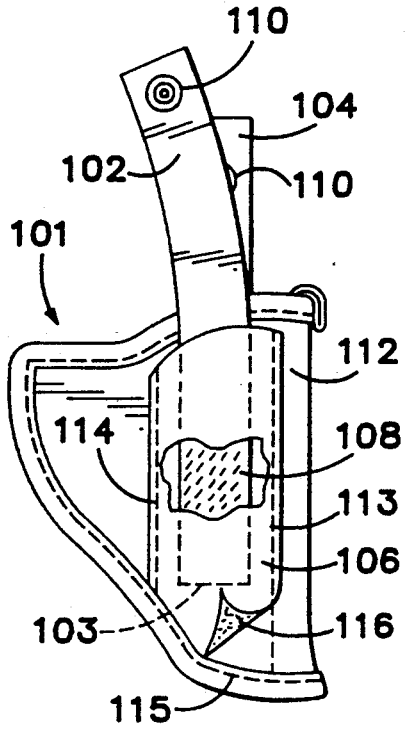
FIG. 11 is a partially cut-away side elevational view of a holster having a piece of the loop portion of the hook-and-loop fastener material attached to the body of the holster according to an alternative embodiment of the invention.

In addition, FIG. 11 illustrates an alternative embodiment of the present invention. Hip holster 101 is similar to the hip holster 45 shown in FIGS. 5, 6, and 7, and may be of a laminated fabric similar to the material of the holster 10. A flexible security strap 102 releasably mates, by a snap fastener 110, with a relatively short, stiff thumb break security strap 104 when needed to hold a handgun securely in the holster 101. A piece of loop-carrying fastener material 106 is sewn to the body 112 along seams 113 and 114 extending along two parallel margins of the piece of loop-Carrying fastener material 106 and along seam 115 holding a binding tape along the margin of the body of the holster. The loop-carrying material 106 is closely fastened to the body 112 along the seams 113, 114, and 115 with the loops facing the body in such a manner that the loop-carrying fastener material 106 itself provides a pocket, open adjacent the top of the holster 101, to receive and cover the lower end 103 of security strap 102. As shown, then, the reverse surface of the fastener material 106 is in the position of the outer surface of the cover 52 of the holster 45. Merely for the sake of illustration, a portion 116 of the loop-carrying material 106 is shown as having been released from seams 113 and 115 and folded back to expose the loops, although, it will be understood, the portion 116 of the fastener material 106 would normally be fastened by those seams 113 and 115. The outer side of the piece of loop-carrying fastener material 106 is an acceptably smooth cloth to form the outer surface of the holster 101.

The security strap 102 is equipped with a piece of securely attached hook-carrying fastener material 108 which mates with the loop-carrying fastener material 106 when the security strap 102 is received behind the loop fastener material 106. The position of the security strap 102 is adjustable in a manner similar to that previously described with respect to holsters 10, 45 and 70. That is, to adjust the position of strap 102 an adjustment device 42 or the equivalent is interposed between the hooks and loops of the pieces of fastener material 106, 108, progressively releasing hooks from loops and freeing the strap to be positioned as desired. Ordinarily the piece of hook-carrying material 108 will be small enough to be entirely covered by the piece of loop-carrying material 106, so that neither the hooks of the fastener material 108, nor any hard or sharp material of the end 103 of the security strap 102 will be exposed.

The terms and expressions which have been employed in the foregoing specification are used therein as terms of description and not of limitation, and there is no intention, in the use of such terms and expressions, of excluding equivalents of the features shown and described or portions thereof, it being recognized that the scope of the invention is defined and limited only by the claims which follow.

What is claimed is:

1. A handgun holster, comprising:

(a) a body having an outside and defining a pocket for receiving a handgun therein;

(b) a security strap having a width, a length, an attachment portion and a handgun-securing portion, said handgun-securing portion having releasable means attached thereto for selectively securing a handgun within said pocket;

(c) a first hook-and-loop fastener material fixedly attached to said attachment portion of said security strap;

(d) a second hook-and-loop fastener material adapted to mate connectingly with said first hook-and-loop fastener material and permanently attached to said outside of said body; and (e) retaining means associated with said body, for holding said security strap with said first hook-and-loop fastener material closely alongside and mated with said second hook-and-loop fastener material for a distance along said security strap equal to at least twice said width of said security strap, attaching said security strap to said body, wherein said retaining means includes cover means for lying snugly against at least some of said second hook-and-loop fastener material, said retaining means being permanently attached to said body in two different locations oriented generally parallel with said length of said security strap and each extending along said body for a distance equal to at least about twice said width of said security strap.

2. The holster of claim 1 wherein said security strap has an end and said cover means and said second hook-and-loop fastener material together define an elongate tube receiving and covering at least said end of said security strap when said first hook-and-loop fastener material is mated with said second hook-and-loop fastener material.

3. The holster of claim 1 wherein said cover means is of sheet-like material.

4. The holster of claim 1 wherein said cover means is of a woven cloth.

5. The holster of claim 1 wherein said cover means is of a synthetic, non-woven, sheet-like material.

6. A handgun holster, comprising:

(a) a body having an outside and defining a pocket for receiving a handgun therein;

(b) a security strap having a width, an attachment portion and a handgun-securing portion, said handgun-securing portion having releasable means attached thereto for selectively securing a handgun within said pocket;

(c) a first hook-and-loop fastener material fixedly attached to said attachment portion of said security strap;

(d) a second hook-and-loop fastener material adapted to mate connectingly with said first hook-and-loop fastener material and permanently attached to said outside of said body; and (e) retaining means associated with said body, for holding said first hook-and-loop fastener material closely alongside and mated with said second hook-and-loop fastener material for a distance along said security strap equal to at least about twice said width of said security strap, attaching said security strap to said body, and wherein said retaining means includes cover means closely overlying at least some of said second hook-and-loop fastener material and permanently attached to said body, and wherein said security strap has an end and said cover means and said second hook-and-loop fastener material together define an elongate tube receiving and covering at least said end of said security strap when said first hook-and-loop fastener material is mated with said second hook-and-loop fastener material, and wherein said cover means is attached to said body along a pair of generally parallel margins of said cover means and along a third margin thereof interconnecting said pair of margins, said cover means and said second hook-and-loop fastener material defining an elongate pocket having an open end to receive said end of said security strap and allowing said first hook-and-loop fastener material to contact said second hook-and-loop fastener material.

7. A fastening system for adjustably attaching a strap to another article, comprising:

(a) an elongate strap having a width, a length, and an end;

(b) a first hook-and-loop fastener material fixedly attached to said end portion of said strap;

(c) a second hook-and-loop fastener material adapted to mate connectingly with said first hook-and-loop fastener material and attached to an article in a location where said elongate strap is to be attached thereto, said second hook-and-loop fastener material being large enough to adjustably receive said elongate strap with at least part of said first hook-and-loop fastener material confronting said second hook-and-loop fastener material; and (d) cover means for lying snugly against said second hook-and-loop fastener material and permanently attached to said article in two different locations each oriented generally parallel with said length of said elongate strap for a distance equal to at least twice said width of said elongate strap, for holding at least part of said first hook-and-loop fastener material closely alongside and mated with at least part of said second hook-and-loop fastener material, said cover means and said second piece of hook-and-loop fastener material defining a receptacle to cover at least said end of said elongate strap.

8. The fastening system of claim 7 wherein said cover means is of a sheet-like material.

9. The fastening system of claim 7 wherein said cover means is of a woven cloth.

10. The fastening system of claim 7 wherein said cover means is of a synthetic, non-woven, sheet-like material.

11. A fastening system for adjustably attaching a strap to another article, comprising:

(a) an elongate strap having an end;

(b) a first hook-and-loop fastener material fixedly attached to said end portion of said strap;

(c) a second hook-and-loop fastener material adapted to mate connectingly with said first hook-and-loop fastener material and attached to an article in a location where said elongate strap is to be attached thereto, said second hook-and-loop fastener material being large enough to adjustably receive said elongate strap with at least part of said first hook-and-loop fastener material confronting said second hook-and-loop fastener material; and (d) cover means closely overlying said second hook-and-loop fastener material and permanently attached to said article, for holding at least part of said first hook-and-loop fastener material closely alongside and mated with at least part of said second hook-and-loop fastener material, said cover means and said second piece of hook-and-loop fastener material defining a receptacle to cover at least said end of said elongate strap, wherein said cover means is further attached to said article along a pair of spaced-apart margins of said cover means and along a third margin of said cover means interconnecting said pair of margins, said cover means and said second hook-and-loop fastener material defining an elongate pocket having an open end to receive at least said end of said elongate strap and allowing said first hook-and-loop fastener material to contact said second hook-and-loop fastener material.

12. A handgun holster, comprising:

(a) a body having an outside and defining a pocket for receiving a handgun therein;

(b) a security strap having a width, a length, an attachment portion, and a handgun-securing portion, said handgun-securing portion having releasable means attached thereto for selectively securing a handgun within said pocket;

(c) a first hook-and-loop fastener material fixedly attached to said attachment portion of said security strap;

(d) a second hook-and-loop fastener material adapted to mate connectingly with said first hook-and-loop fastener material and permanently attached to said outside of said body; and (e) retaining means associated with said body, for holding said first hook-and-loop fastener material closely alongside and mated with said second hook-and-loop fastener material for a distance along said security strap equal to at least about twice said width of said security strap, attaching said security strap to said body, wherein said retaining means includes said second hook-and-loop fastener material and said second hook-and-loop fastener material has a mating surface, and wherein said retaining means is permanently attached to said outside of said body in two different locations each oriented generally parallel with said length of said security strap in such a manner that said mating surface lies snugly against said body in a location where said security strap is to be attached thereto, for receiving said security strap adjustably between said mating surface and said body.

* * * * *